US011160354B2

(12) United States Patent
Martínez Fierro

(10) Patent No.: US 11,160,354 B2
(45) Date of Patent: Nov. 2, 2021

(54) BACKPACK WITH INFLATABLE ELEMENT AND FASTENING ELEMENTS

(71) Applicant: Jorge Ramón Martínez Fierro, Mexico City (MX)

(72) Inventor: Jorge Ramón Martínez Fierro, Mexico City (MX)

( * ) Notice: Subject to any disclaimer, the term of this patent is extended or adjusted under 35 U.S.C. 154(b) by 0 days.

(21) Appl. No.: 17/255,626

(22) PCT Filed: Jun. 25, 2018

(86) PCT No.: PCT/MX2018/000058

§ 371 (c)(1),
(2) Date: Dec. 23, 2020

(87) PCT Pub. No.: WO2020/005050

PCT Pub. Date: Jan. 2, 2020

(65) Prior Publication Data

US 2021/0267358 A1 Sep. 2, 2021

(51) Int. Cl.
*A47D 13/02* (2006.01)
*A45F 3/04* (2006.01)
(Continued)

(52) U.S. Cl.
CPC ..... *A45F 4/02* (2013.01); *A45F 3/00* (2013.01); *A47D 13/025* (2013.01);
(Continued)

(58) Field of Classification Search
CPC .... A45F 3/14; A45F 3/047; A45F 4/02; A45F 3/00; A45F 2003/003; A45F 2003/045;
(Continued)

(56) References Cited

U.S. PATENT DOCUMENTS 3,902,640 A * 9/1975 Geiben ..... A45F 3/04 224/629
3,968,910 A * 7/1976 Dye ..... A47D 13/025 224/161

(Continued)

OTHER PUBLICATIONS

Soybu Womens Moksha Convertible Bag. Amazon, 2016 [retrieved on Oct. 11, 2018]. Retrieved 1-3, 5-6. 8-11 from the Internet: <URL: https://web.archive.org/web/20160330024401/https://www.amazon.com/Soybu-Womens-Moksha-Convertible-Bag/dp/B011 E5WBJM>.

(Continued)

*Primary Examiner* — Brian D Nash
(74) *Attorney, Agent, or Firm* — Polson Intellectual Property Law, PC; Margaret Polson

(57) ABSTRACT

A backpack with an inflatable element, designed to facilitate comfort during transport. One of the aims of the backpack is to allow objects and/or elements to be placed therein. The backpack also has an integrated inflatable element that acts as a seat for a child, wherein the child sits on said element, on the shoulders of the user of the backpack. In addition, the backpack has a pair of harnesses that can be removed from straps, used to securely surround the legs and/or ankles of the child. When the backpack is placed in front of the user's torso, the inflatable element also allows the user to rest his/her head and, at the same time, the user can rest his/her arms by placing them in a hollow structure located at the front of the backpack, preferably as part of the configuration of an exterior bag.

9 Claims, 4 Drawing Sheets

(51) Int. Cl.
*A45F 4/02* (2006.01)
*A45F 3/00* (2006.01)

(52) U.S. Cl.
CPC ... *A45F 2003/003* (2013.01); *A45F 2003/045* (2013.01); *A45F 2004/026* (2013.01)

(58) Field of Classification Search
CPC ..... A45F 2004/026; A47D 13/025; A47D 15/006
See application file for complete search history.

(56) References Cited

U.S. PATENT DOCUMENTS 4,484,700 A 11/1984 Bush
4,746,044 A * 5/1988 Arvizu ..... A47D 13/025 224/155
4,750,654 A * 6/1988 Menetrier ..... A45F 3/04 224/630
4,842,173 A 6/1989 Scherer
5,437,402 A * 8/1995 Ring ..... A47D 13/025 128/882
5,547,461 A * 8/1996 Levis ..... A45F 3/04 128/876
5,577,648 A * 11/1996 Sason ..... A45F 3/04 224/264
5,975,387 A * 11/1999 Gleason ..... A45F 3/047 224/148.2
6,098,856 A * 8/2000 Reilly ..... A47D 13/025 224/159
6,109,495 A * 8/2000 Hernandez ..... A45F 3/12 224/264
6,179,186 B1 * 1/2001 Blanking ..... A45F 3/04 224/153
D443,758 S * 6/2001 Stylianou ..... D3/216
7,631,792 B2 * 12/2009 Christy ..... A45F 3/04 224/642
7,717,310 B2 * 5/2010 Zalinsky ..... A45F 3/12 224/644
8,172,116 B1 * 5/2012 Lehan ..... A47D 13/025 224/160
8,474,667 B2 * 7/2013 Schwartz ..... A47D 13/086 224/159
8,783,530 B1 * 7/2014 Jordan ..... A47D 13/025 224/159
9,578,953 B2 * 2/2017 Chueh ..... A45F 3/04
9,949,575 B2 * 4/2018 Pond ..... A47D 13/025
10,271,665 B1 * 4/2019 Tito ..... A47D 13/025
2002/0189003 A1 * 12/2002 Babcock ..... A45F 3/14 2/268
2005/0205634 A1 9/2005 Han
2007/0246493 A1 * 10/2007 Kernkamp ..... A47D 13/025 224/159
2008/0149677 A1 6/2008 Howell
2008/0296328 A1 12/2008 Wu
2011/0186605 A1 * 8/2011 Favorito ..... A47D 13/025 224/160
2013/0092796 A1 * 4/2013 Weinel ..... A45F 3/10 244/149
2015/0335171 A1 11/2015 Tagle
2016/0015094 A1 1/2016 Walker et al.
2016/0016043 A1 1/2016 Rose et al.
2017/0274229 A1 * 9/2017 Werz ..... A45F 3/14

OTHER PUBLICATIONS

Osprey Rev 1.5 Trail Running Pack Review. Outdoors Magic, 2016 [retrieved on Oct. 11, 2018]. 1-3, 5-6, 8-11 Retrieved from the Internet: <URL: https:1/outdoorsmagic.com/reviews/osprey-rev-1-5-trail-running-pack-review/>.
International Search Report dated Nov. 8, 2018 in parent International application PCT/MX18/00058.
Written Opinion of the International Searching Authority dated Nov. 8, 2018 in parent International application PCT/MX18/00058.

* cited by examiner

BACKPACK WITH INFLATABLE ELEMENT AND FASTENING ELEMENTS

BACKGROUND

Technological development over the years has made traveling and/or moving increasingly more comfortable through the design of backpacks and devices that facilitate the handling and transfer of personal effects.

Under this premise, different tools and devices have been designed that improve comfort in transport and movement, stating the following documents as the most interesting in this regard.

Document PCT/US2016/045404 discloses a child carrier and support apparatus for securing a child in a seated position on top of the user's shoulders, which is adapted to fit with a conventional backpack.

Document US 20160331161 A1 discloses a cushion designed for a person to use it to take a break in his/her office or desk by placing his/her face in the hole of the device.

Document CN 105640182 describes a support cushion structure and is used for the user to sleep or to perform sedentary activity facing down towards the cushion structure with the user's hands and arms placed under his/her face.

Document CN 203841279 refers to a backpack with an additional support device for the head and the neck. The backpack induces a backpack body, a vertically positioned bracket arranged in the center of the inner back of the backpack body, a jaw rest cup that matches the support that is arranged on the backpack body, located at the top of said support.

Document U.S. Pat. No. 5,645,319 A discloses an inflatable pillow in which passengers in an airplane or bus sitting in rows of seats facing forward can bend forward, rest their heads and relax. The shape of the pillow, once inflated, is predetermined to substantially occupy the space in front of said passengers.

Document US 20040064893 A1 refers to an inflatable resting device that is comprised by at least one air chamber having a generally bell shape. Arm support structures are provided along the sides of the rest device to support the user's arms in a comfortable resting position.

Document U.S. Pat. No. 8,984,688 B1 discloses an inflatable rest pillow comprising two inflatable compartments, the lower compartment providing a base to support the attached upper compartment; both compartments are inflatable separately.

However, despite the different solutions presented, the problem of having all these accessories in a single product in order to increase travel comfort has not yet been solved. Most of the cases present a pillow-shaped kneeler or simply an inflatable extension; using any of the options described above, a backpack or container which gives the option of resting in an optimal way while the passenger's belongings are secured is still necessary. Therefore, through the present specification, a new solution is proposed to solve this problem in a simple and efficient way.

SUMMARY

The present disclosure relates to a backpack, specifically to a backpack with an inflatable element that works as a headrest and at the same time as a child seat, holding the child's feet with harnesses attached to the backpack straps. For example, a backpack with straps includes an inflatable element in the top, fastening harnesses attached to the straps, pads located on the backrest, a rigid core inside and a rest element in its front part.

DETAILED DESCRIPTION

Figure 1:
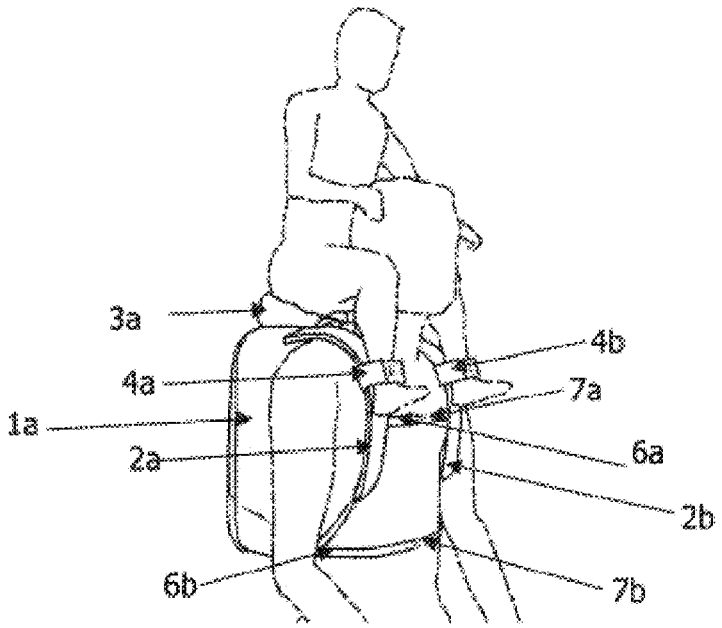
FIG. 1 shows a front perspective view of the backpack in a child seat embodiment.
Figure 2:
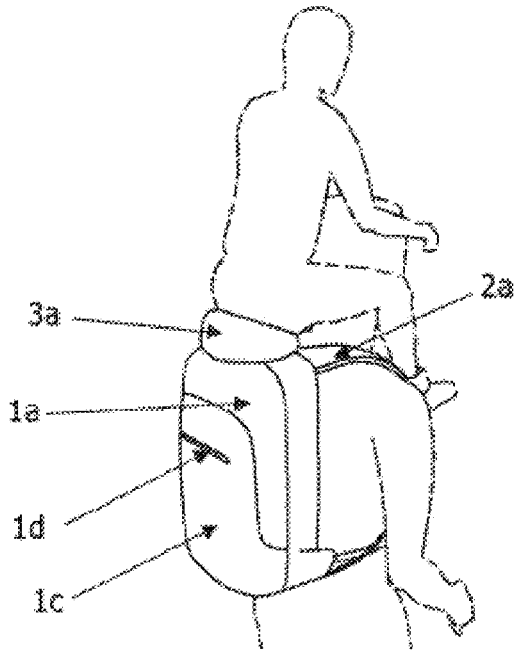
FIG. 2 shows a rear perspective view of the backpack in a child seat embodiment.
Figure 3:
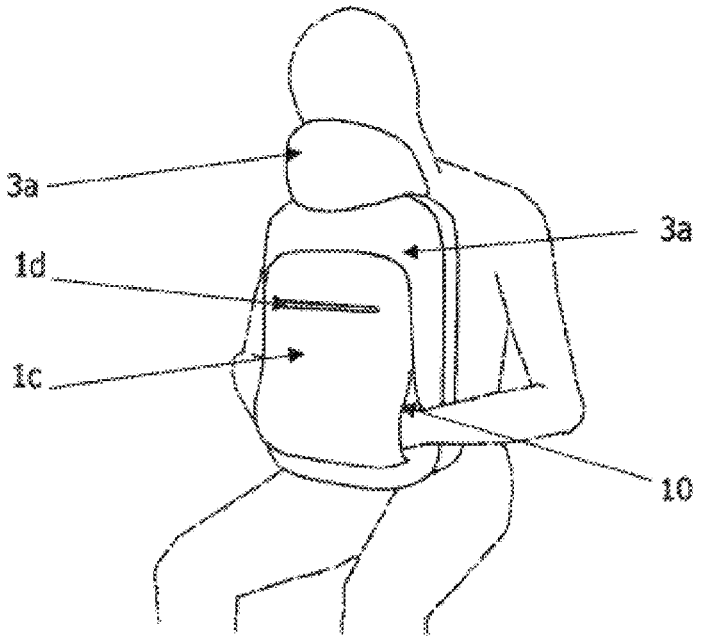
FIG. 3 shows a front perspective view of the backpack in a headrest embodiment.
Figure 4:
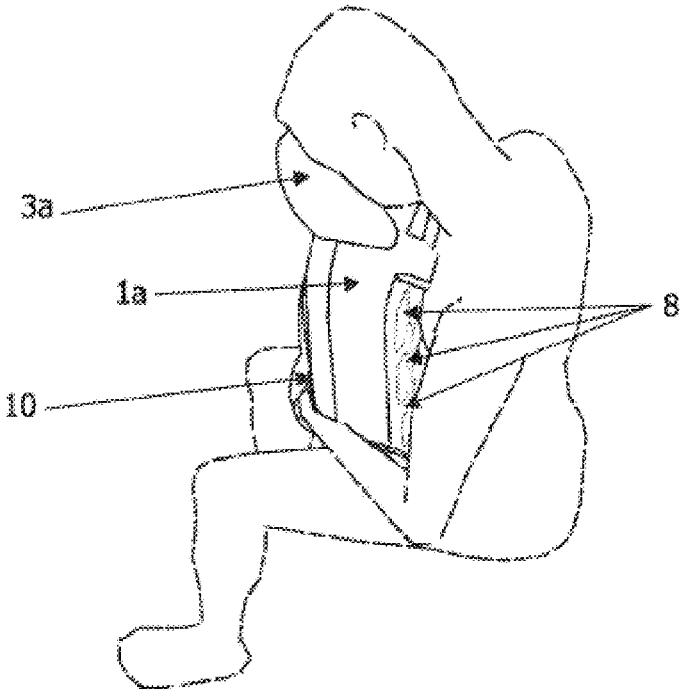
FIG. 4 shows a rear perspective view of the backpack in a headrest embodiment.
Figure 5:
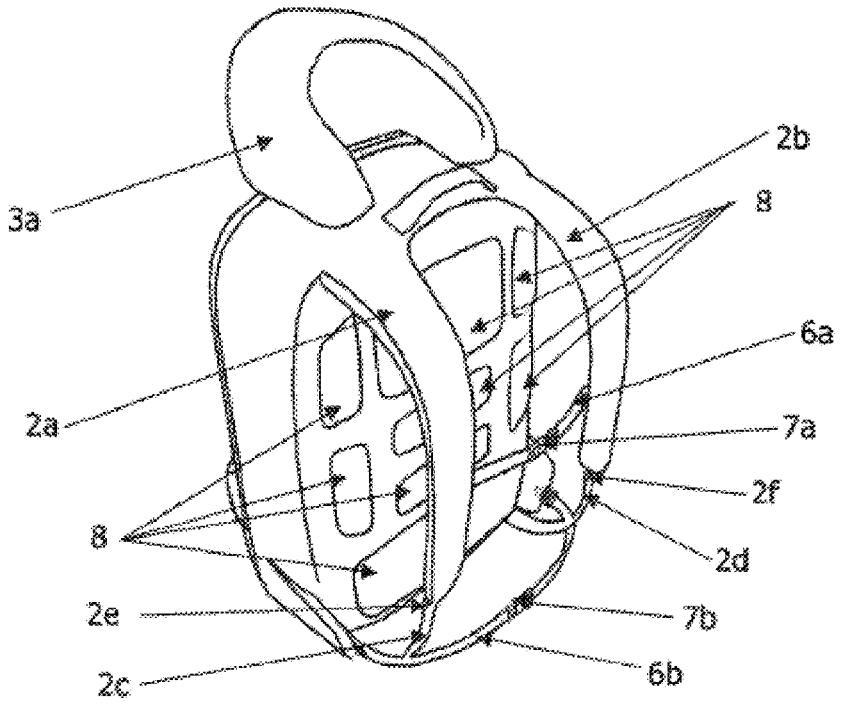
FIG. 5 shows a rear perspective view of the backpack.
Figure 6:
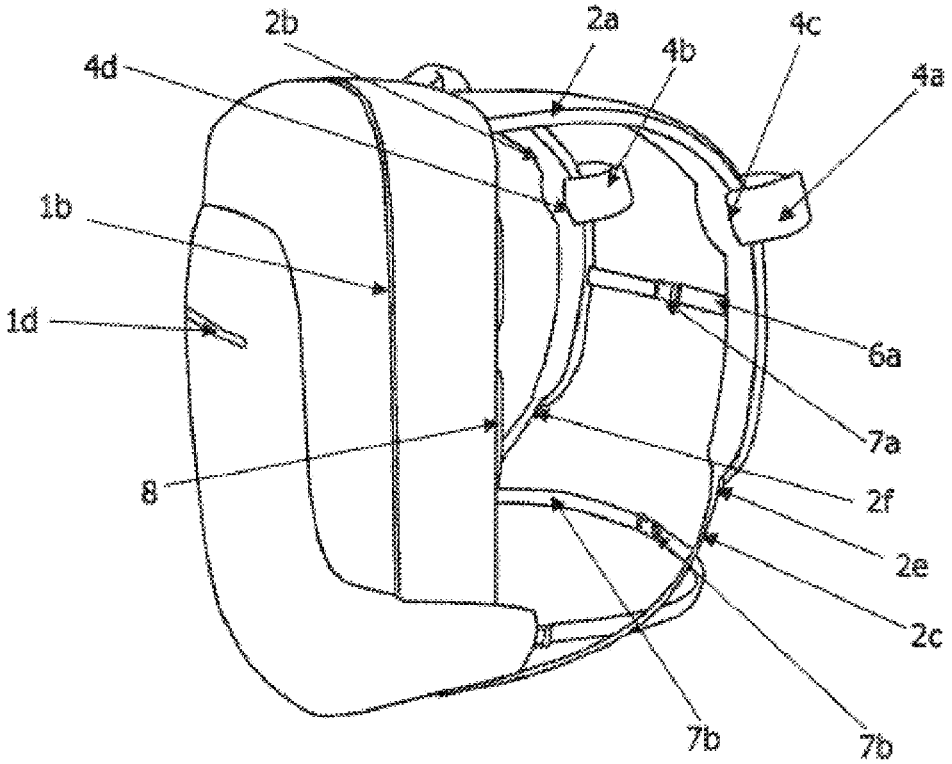
FIG. 6 shows a side view of the backpack with the harnesses attached to the straps.
Figure 7:
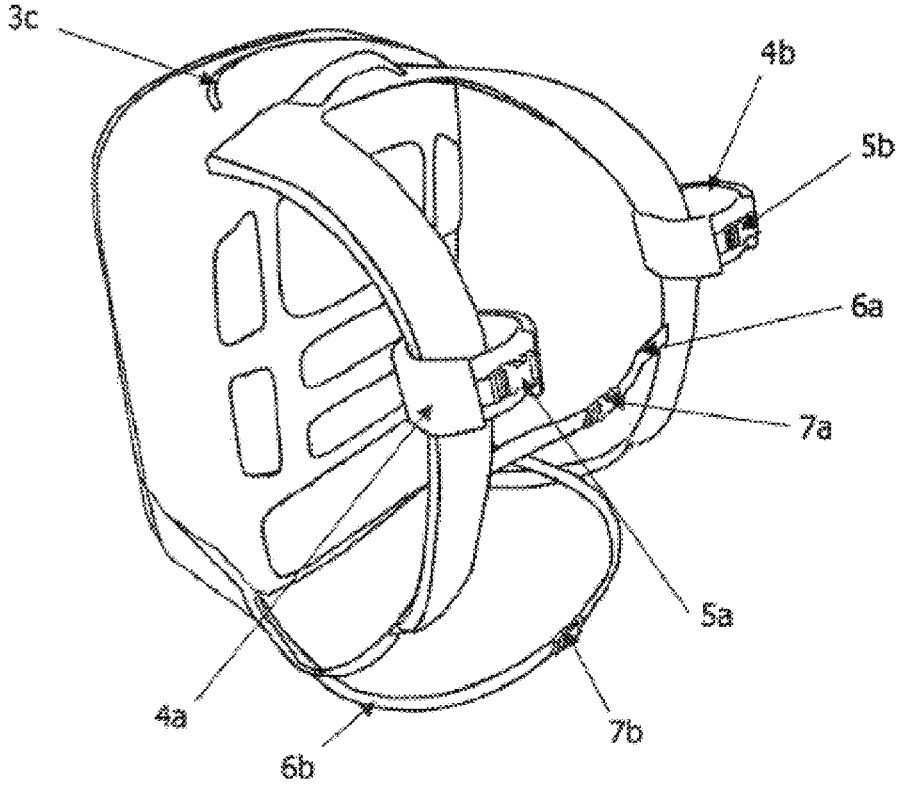
FIG. 7 shows a rear perspective view of the backpack with the harnesses attached to the straps.
Figure 8:
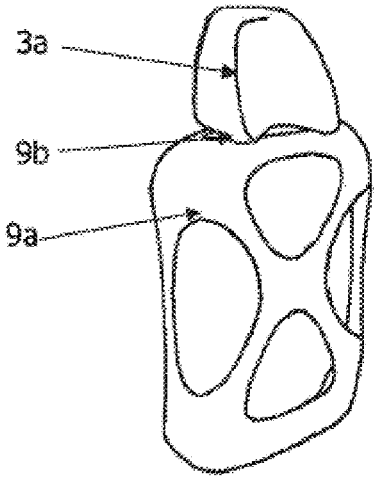
FIG. 8 shows a rear perspective view of the rigid core with the inflatable element deployed.

With reference to the depicted embodiments of FIGS. 1-8, a backpack comprises a luggage element (1*a*) that can be placed both on the back and in front of the torso, adjustable to the user by means of two straps that pass through his/her shoulders, each comprising a main strap (2*a*, 2*b*) attached to the top of the luggage element (1*a*), a strap (2*c*, 2*d*) attached to the bottom of the luggage element (la), wherein the main strap and the belt are coupled by means of an adjusting element (2*e*, 2*f*) which is attached to the main strap and wherein the belt is inserted into the adjustment element to regulate its extension.

In the top of the backpack there is an inflatable element (3*a*) preferably attached through a flange topped by a thread pattern sewn to the structure of the luggage element (1*a*). In order to be filled with air, the inflatable element has a nozzle to carry out manual or automatic inflation, that is, through the introduction of air by mechanical means such as manual or electric pumps or human means, among other means unrelated to the structure of the backpack. Said inflatable element (3*a*) comprises two main uses: it works as a support wherein the user can rest and/or support the head and it also works as a seat for whenever the user decides to mount and seat a person on his/her shoulders, for example, an infant or child.

In order to hold the legs of the person mounted on the shoulders of the user of the backpack, this comprises at least one pair of harnesses (4*a*, 4*b*) coupled to the straps (2*a*, 2*b*) of the backpack similar to clamps. Each harness closes in a circular manner and adjusts its extension using a lock (5*a*, 5*b*) of varying configuration and obvious to any person skilled in the art.

Additionally, the backpack also comprises at least one pair of fasteners (6*a*, 6*b*) that are located at the back, between the straps (2*a*, 2*b*). Said fasteners each comprise two belts that run in cross-section from one strap to the other horizontally, in such a way that they engage each other by means of a lock (7*a*, 7*b*) of varying configuration and obvious to any person skilled in the art. These fasteners (6*a*, 6*b*) have the main purpose of providing safety to the child seated on the user's shoulders when the user places the backpack on his/her back, and the child is secured by the harnesses (4*a*, 4*b*) attached to the straps (2*a*, 2*b*). The fasteners (6*a*, 6*b*) limit the mobility of the straps (2*a*, 2*b*) so that there are no problems while the child is held on the inflatable element (3*a*). For example, the straps could move from their position on the user's shoulders and separate from each other, which would cause the child to fall derived from the backpack's bad position; it is in this situation wherein the straps retain the position of the straps on the user's shoulders. Furthermore, the fasteners (6*a*, 6*b*) distribute the stress exerted by the weight of the backpack and/or of the child, avoiding excessive load on the user's shoulders.

On the surface of the back of the luggage element (la), usually corresponding to the backrest and distributed evenly, the backpack has a plurality of cushion and/or pad-type elements (8) that serve to provide rest and comfort both on the user's back and torso, depending on how the backpack is placed. The pads (8) have a soft-touch surface and are filled with a padded material, creating cushions distributed over the surface of the back of the backpack.

In order to preserve the shape of the backpack, it also comprises a rigid core (9*a*) coupled therein, on the internal wall of the backrest. The core in turn comprises a concave structure, essentially rectangular in shape with rounded edges and made from a light material that is sufficiently rigid to keep the backpack upright. In this way, the backpack remains vertical and provides the user with additional support when securing the load in different situations of use, for example and without limitation: in case of carrying a very heavy load inside the luggage element (1*a*), in case of carrying an infant or child on the shoulders adjusted to the harnesses (4*a*, 4*b*) and even when the backpack is used as a resting accessory when the user places it in front of his/her torso and rests his/her head on the inflatable element (3*a*), wherein said inflatable element passes through a hole or slot (9*b*) made in the top of the core (9*a*).

Additionally, a resting structure (10) is provided in the front part of the device to support the arms in a comfortable resting position, comprising a sleeve or bag-type horizontal tubular structure opened at two ends, in which the user can insert his/her arms.

In designing the backpack, as well as the accessories thereof, it is preferable to take into account certain considerations, for example, when securing an infant or child to the backpack.

Some of the considerations that have served to achieve the result proposed by the present disclosure are included, but not limited to, below. It should be clarified that the inclusion of the following information does not limit the modification of characteristics included or not included in the present specification, and that any modification and/or combination of one or more of said characteristics must be considered as an embodiment of this invention. Likewise, the combination of one or more of the following preferred embodiments should be considered within the potential scope of the invention herein disclosed.

In a first preferred embodiment, the object of the backpack is to be able to carry objects and/or elements therein. Therefore, the luggage element (1*a*) comprises a closing element (1*b*) that preferably surrounds the structure of the luggage element, starting on one side, passing through the top and ending on the opposite side, wherein the closing element allows to secure content inside of said luggage element (1*a*). Generally, the backpack is placed on the back supported by the two straps (2*a*, 2*b*), which pass over the shoulders.

In another preferred embodiment, the adjusting element (2*e*, 2*f*) comprises a buckle in which the belt (2*c*, 2*d*) is inserted and tied to the main strap (2*a*, 2*b*). The buckle is attached to said main strap preferably by means of a tie finished with a sewn pattern of thread that increases the strength of the tie.

In another preferred embodiment where the user wants to rest, typically the backpack is placed in front of the users torso and has the inflatable element (3*a*), which serves so that the user can rest his/her head. Said element is inflated through a nozzle located on the surface of the inflatable element (3*a*) and communicated with the inside, to which valves, pumps or the user's mouth can be coupled in order to inflate it. To use the backpack in this way, the user must place it with the torso in a vertical position, so that, once the Inflatable element (3*a*) has been inflated, the user reclines his/her head on it. Following this embodiment, the user can also rest his/her arms: once the backpack is placed in front of the torso, the user can place his/her arms inside the resting structure (10) that is located at the front thereof. All this is with the aim that the user can have maximum comfort and can rest safely.

In another preferred embodiment, the resting structure (10) is comprised in the structure of an outer bag (1*c*) of the luggage element (1*a*), located in the front of the backpack. The outer bag comprises a hollow structure coupled to the front face of the luggage element and a closing element (1*d*), for example a zipper, for the protection of small items. In the bottom of the outer bag (1*c*) is the resting structure (10), that is, the sleeve that comprises it crosses the outer bag from one side to the other, generating a tubular structure where the user can insert his/her arms.

In another preferred embodiment, when the inflatable element (3*a*) is not being used, it is stored in a pocket with a closing element (3*c*), for example, a "zipper" type element, to facilitate the deployment and protection of said inflatable element.

In another preferred embodiment where the backpack is used as an infant or child carrier, the backpack works as follows: having the Inflatable element (3*a*) deployed and inflated, the user places the backpack on his/her back. The inflatable element (3*a*) works as a seat for the child, wherein the child is seated on said inflatable element, on the shoulders of the backpack user (see FIGS. 1 and 2). The backpack also presents the pair of harnesses (4*a*, 4*b*), which are removable from the straps (2*a*, 2*b*), which surround and secure the legs and/or ankles of the seated child. In order to allow the coupling and removal of the harnesses (4*a*, 4*b*) to the backpack, the straps each comprise a cross section, from side to side across the width of the strap, which generates a pair of grooves (4*c*, 4*d*) into which the harnesses (4*a*, 4*b*) are inserted and secured. The cross section is made in such a way that when the harnesses are not coupled, the cross section is invisible; and it only becomes visible when both faces of the straps are bent and separated to give rise to the grooves (4*c*, 4*d*).

In another preferred embodiment, the locks (5*a*, 5*b*, 7*a*, 7*b*) are two-part locks or clasps, each part coupled at one end of the harness or fastener to which they are attached. The two-part locks generally comprise a male part that is inserted and secured to its female counterpart, by means of mechanical pressure exerted by the material from which they are made. It will be obvious to a person skilled in the art that the configuration of the locks is variable and does not limit the scope of the present disclosure, wherein the configuration may comprise any of the following options or a different one: fastening elements, velcro elements, zippers, etc.

Although the invention has been described with reference to certain preferred embodiments thereof, this is not limiting for the backpack to be used with other types of articles or devices in order to improve the comfort of the user. Furthermore, it will be apparent that various versions, variations and/or adaptations can be made without departing from the spirit and scope defined in the appended claims.

Having sufficiently described my invention, I consider as a novelty and therefore claim as my exclusive property, what is contained in the following claims:

1. A backpack comprising:

a luggage element with a closing element;

an inflatable element which is inflatable via a nozzle and attached to a top of the backpack, the inflatable element storable in a pocket with a closing element in the top of the backpack;

two straps attached to the top of the luggage element, each strap attached to a belt via an adjusting element, wherein the belt is also attached to a bottom of the luggage element;

two harnesses configured to be coupled to the straps via a cross sectional cutting from side to side that creates a slot in each strap in which the harnesses are inserted and secured;

at least two fasteners attached to the straps;

a resting structure for arms located on the front of the backpack; and a rigid core located in the inner back of the backpack, the rigid core comprises a concave rectangular-shaped structure with rounded edges and a groove made in the top thereof whereby the inflatable element passes through.

2. The backpack of claim 1, wherein the luggage element comprises a plurality of pads distributed evenly in the back corresponding to the backrest.

3. The backpack of claim 1, wherein the adjustment element comprises a buckle in which the belt is inserted and tied to the strap.

4. The backpack of claim 1, wherein the harnesses are closed in a circular manner and each comprise, in turn, a lock that adjusts the extension of the harness.

5. The backpack of claim 1, wherein the fasteners comprise two belts that go from one strap to the other horizontally that are fastened therebetween by means of a lock.

6. The backpack of claim 1, wherein the inflatable element is attached to the top of the backpack through a flange topped by a thread pattern sewn to the structure of the luggage element.

7. The backpack of claim 1, wherein the nozzle is located on the surface of the inflatable element and communicates with the inside thereof.

8. The backpack of claim 1, wherein the resting structure comprises a sleeve or bag-type horizontal tubular structure opened at two ends.

9. The backpack of claim 1, wherein the resting structure is comprised in the structure of an outer bag which in turn comprises a hollow structure coupled to the front face of the luggage element and a closing element.

* * * * *